US006871145B2

(12) United States Patent
Altan et al.

(10) Patent No.: US 6,871,145 B2
(45) Date of Patent: Mar. 22, 2005

(54) METHOD AND SYSTEM FOR VEHICLE IMPACT ASSESSMENT USING DRIVER BRAKING ESTIMATION

(75) Inventors: Osman D. Altan, Northville, MI (US); Raymond J. Kiefer, Huntington Woods, MI (US); William J. Chundrlik, Jr., Rochester Hills, MI (US); Pamela I. Labuhn, Shelby Township, Macomb County, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/305,433

(22) Filed: Nov. 26, 2002

(65) Prior Publication Data

US 2004/0102901 A1 May 27, 2004

(51) Int. Cl.[7] ..... G08G 1/16
(52) U.S. Cl. ..... 701/301; 340/436
(58) Field of Search ..... 701/301, 45; 342/70, 342/71, 72; 340/436

(56) References Cited

U.S. PATENT DOCUMENTS 5,357,438 A * 10/1994 Davidian ..... 701/301
5,594,414 A * 1/1997 Namngani ..... 340/436
5,684,473 A * 11/1997 Hibino et al. ..... 340/903
5,865,265 A * 2/1999 Matsumoto ..... 180/169
6,044,321 A * 3/2000 Nakamura et al. ..... 701/96
6,201,493 B1 3/2001 Silverman ..... 342/20
6,429,789 B1 * 8/2002 Kiridena et al. ..... 340/905
6,679,702 B1 * 1/2004 Rau ..... 434/29

FOREIGN PATENT DOCUMENTS

WO WO 01/11388 2/2001

* cited by examiner

*Primary Examiner*—Michael J. Zanelli
(74) *Attorney, Agent, or Firm*—Kathryn A. Marra

(57) ABSTRACT

A method for predicting an impact condition between a host vehicle and an object detected in a path of travel of the host vehicle includes receiving measured parameters from the host vehicle and the object, and receiving a system sensitivity input from a driver of the host vehicle. A braking response of the driver of the host vehicle is estimated, based on the received system sensitivity input, and a projected travel range profile for both the host vehicle and the object is determined, based upon the measured parameters and the estimated braking response. The impact condition is established whenever a comparison of the projected travel range profile for the host vehicle and for the object establishes an intersection therebetween.

22 Claims, 9 Drawing Sheets

METHOD AND SYSTEM FOR VEHICLE IMPACT ASSESSMENT USING DRIVER BRAKING ESTIMATION

BACKGROUND

The present disclosure relates generally to vehicle object detection systems and, more particularly, to a method and system for vehicle impact assessment using driver braking estimation.

One of the more recent systems to be developed in the automotive industry is the forward collision warning (FCW) system. An FCW system is intended to mitigate and/or eliminate frontal impacts by generating a timely warning to the driver to take an evasive action. Typically, a vehicle is configured with a sensor (or sensors) that is capable of detecting objects in the frontal area of the vehicle. The sensor not only detects the presence of an object, but also provides some quantitative information about the object such as range, range rate, and azimuth position of the object. Additional information related to the object (e.g., a lead vehicle in many instances) may include relative acceleration, the size of the object, the dimensions of the object, the direction of movement of the object, etc. Generally speaking, two main technologies are most prevalent in gathering such object information: (1) laser technology; and (2) radar technology.

In addition to the gathered object data, an FCW system also typically incorporates a threat assessment algorithm, which evaluates the incoming data, analyzes the particular situation, and then determines if there is any imminent threat of impacting an object in the frontal area of the vehicle. Many of these algorithms are based on parameters such as "time to impact", "time headway", or perhaps basic vehicle kinematics. In any case, the output of the algorithm will determine if the FCW system will cause a warning to be issued to the driver.

False alarms generated from a FCW system are a source of nuisance to the driver. Such false alarms may result from erroneous information picked up from the sensor(s), or may be generated as the result of shortcomings in the threat assessment algorithm itself. In the latter case, the false alarm is a "too early" warning, which can annoy the driver. On the other hand, a missed detection results from a situation where an impact warning was supposed to be issued by the FCW system, but was not, due to erroneous sensor information or due to the threat assessment algorithm. The latter is in the form of a "too late" warning, or even no warning at all, such that the overall effectiveness of the system is compromised or diminished. However, algorithms based only on the above mentioned parameters tend to exhibit these characteristics.

SUMMARY

In an exemplary embodiment, a method for predicting an impact condition between a host vehicle and an object detected in a path of travel of the host vehicle includes receiving measured parameters from the host vehicle and the object, and receiving a system sensitivity input from a driver of the host vehicle. A braking response of the driver of the host vehicle is estimated, based on the received system sensitivity input, and a projected travel range profile for both the host vehicle and the object is determined, based upon the measured parameters and the estimated braking response. The impact condition is established whenever a comparison of the projected travel range profile for the host vehicle and for the object establishes an intersection therebetween.

In another aspect, a method for generating a frontal impact warning for a driver of a host vehicle includes determining, during a given sample time period, actual velocity and acceleration data for both the host vehicle and for a lead vehicle detected in the path of travel of the host vehicle. A braking response of the driver of the host vehicle is estimated, and a deceleration value for the lead vehicle is assigned. Then, a projected travel range for the host vehicle is generated, based upon the actual velocity data for the host vehicle and the lead vehicle, and further based upon the estimated braking response of the driver of the host vehicle. A projected travel range is also generated for the lead vehicle, based upon the actual velocity data for the lead vehicle and upon the assigned deceleration value for the lead vehicle. The projected travel range for the host vehicle is compared with the projected travel range for the lead vehicle, and an alert signal is generated to the host vehicle driver whenever an intersection of travel ranges therebetween is calculated.

In still another aspect, a forward impact warning system includes an algorithm for assessing the likelihood of a frontal collision between a host vehicle and a lead vehicle detected in the path of travel of the host vehicle. The algorithm has actual velocity and acceleration data for the host vehicle and the lead vehicle as inputs thereto. In addition, the algorithm further estimates a braking response of the driver of the host vehicle, and generates a projected travel range for the host vehicle, based upon the actual velocity data for the host vehicle and the lead vehicle, and further based upon the estimated braking response of the driver of the host vehicle. The algorithm also assigns a deceleration value for the lead vehicle, and generates a projected travel range for the lead vehicle, based upon the actual velocity data for the lead vehicle and upon the assigned deceleration value for the lead vehicle. A warning alert is in communication with the algorithm, the warning alert mechanism generating an alert signal to the driver of the host vehicle whenever the algorithm identifies an intersection between the projected travel range for the host vehicle and the projected travel range for the lead vehicle.

BRIEF DESCRIPTION OF THE DRAWINGS

Referring to the exemplary drawings wherein like elements are numbered alike in the several Figures.

DETAILED DESCRIPTION

Figure 1:
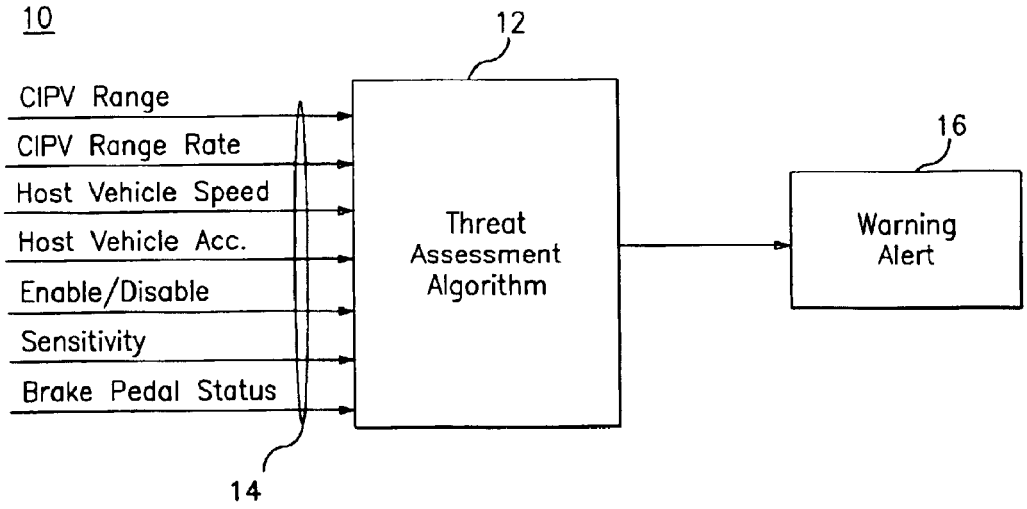
FIG. 1 is a block diagram illustrating a system for vehicle impact assessment using driver braking estimation, in accordance with an embodiment of the invention.

Referring initially to FIG. 1, there is shown a block diagram illustrating a system 10 for vehicle impact assessment using driver braking estimation, in accordance with an embodiment of the invention. The system 10 implements a threat assessment algorithm 12 having a plurality of inputs 14 thereto. The inputs 14 include measured vehicle parameters of both a lead and a follow (host) vehicle, as well as host driver inputted and estimated parameters. Particularly, the input parameters include Closest In Path Vehicle (CIPV) range, CIPV range rate, Host Vehicle Speed, Host Vehicle Acceleration, a driver Enable/Disable input, a Sensitivity input, and a Brake Pedal Status input.

As described in greater detail later, the particular level of sensitivity input selected by the host vehicle driver is used as an estimator of the braking response time of the driver. The threat assessment algorithm 12, during a given sample period will assess whether an alarm signal is sent to a warning alert block 16, which in turn provides an indication (e.g., an audio and/or visual signal) to the host vehicle driver that an impact is imminent.

Figure 2:
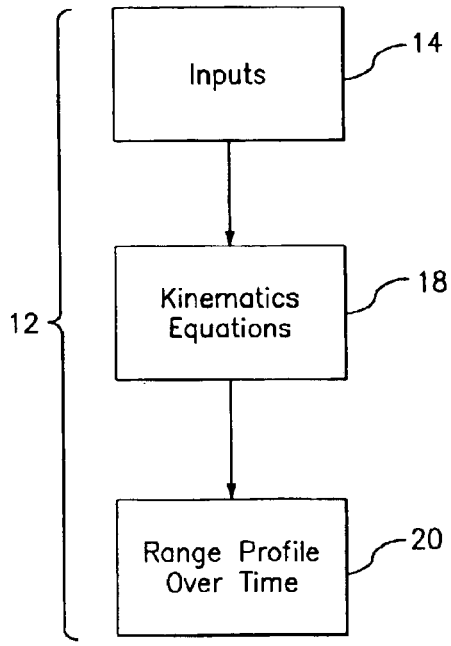
FIG. 2 is a block diagram illustrating the general structure of a threat assessment algorithm shown in FIG. 1.

FIG. 2 is a block diagram that illustrates the general process by which the threat assessment algorithm 12 processes the inputs thereto in order to determine whether the alarm signal is generated. Once the inputs 14 (as shown in FIG. 1) are received for a given sample cycle, the algorithm 12 first estimates the host vehicle driver braking effort, driver response time, and lead vehicle deceleration. The algorithm 12 then applies a set of kinematics equations 18 to the inputs 14, thereby generating a range profile 20, over time, for both the host vehicle and the closest in path lead vehicle. By comparing the range profiles of each vehicle, the algorithm 12 determines whether there is at least one intersection therebetween that is indicative of an impact between the two vehicles. If so, then an alarm signal is generated. If not, then no alarm signal is generated. However, the process is repeated at each new sample period, with new range profiles being generated using the latest input data.

Figure 3:
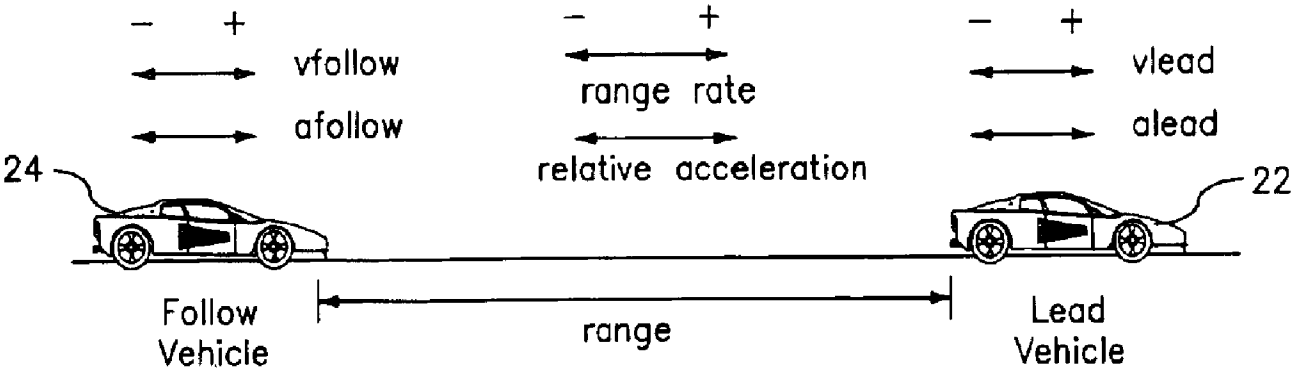
FIG. 3 is schematic diagram of a lead vehicle and a follow (host) vehicle, particularly illustrating some of the measured/calculated parameters used by the threat assessment algorithm.
Figure 4A:
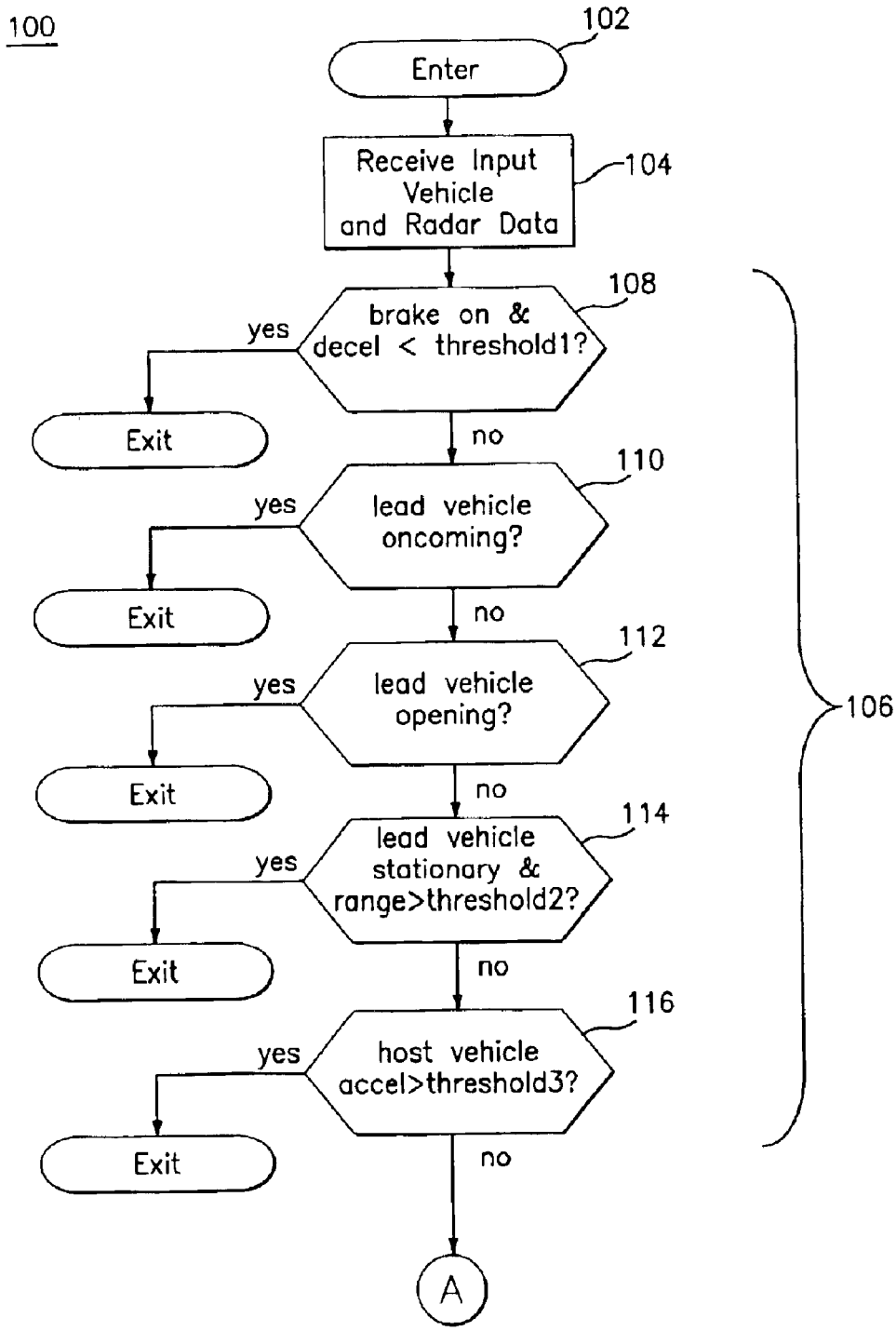
FIGS. 4(*a*) through 4(*d*) illustrate an exemplary embodiment of the threat assessment algorithm represented by a flow diagram.
Figure 4B:
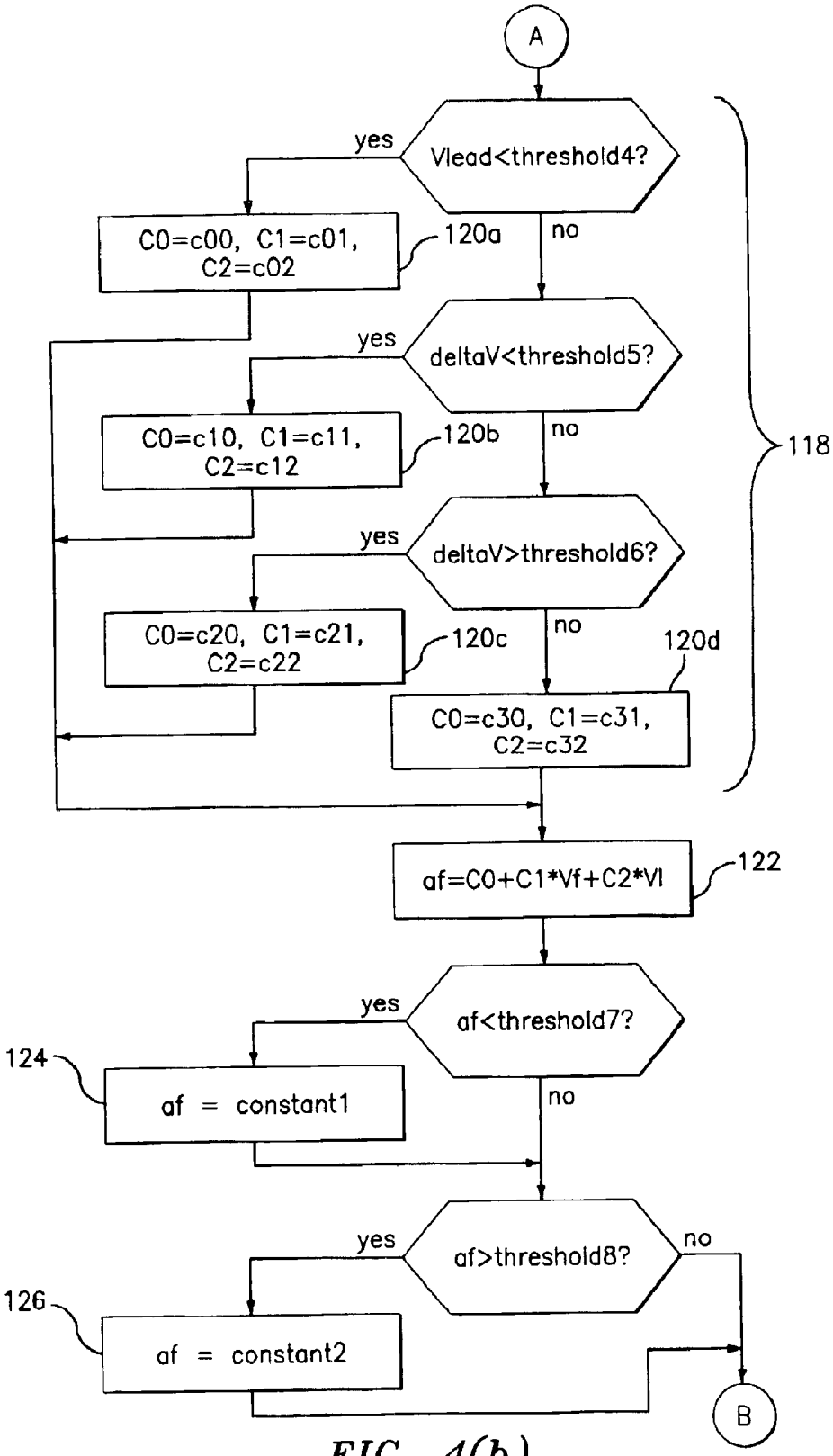
Figure 4C:
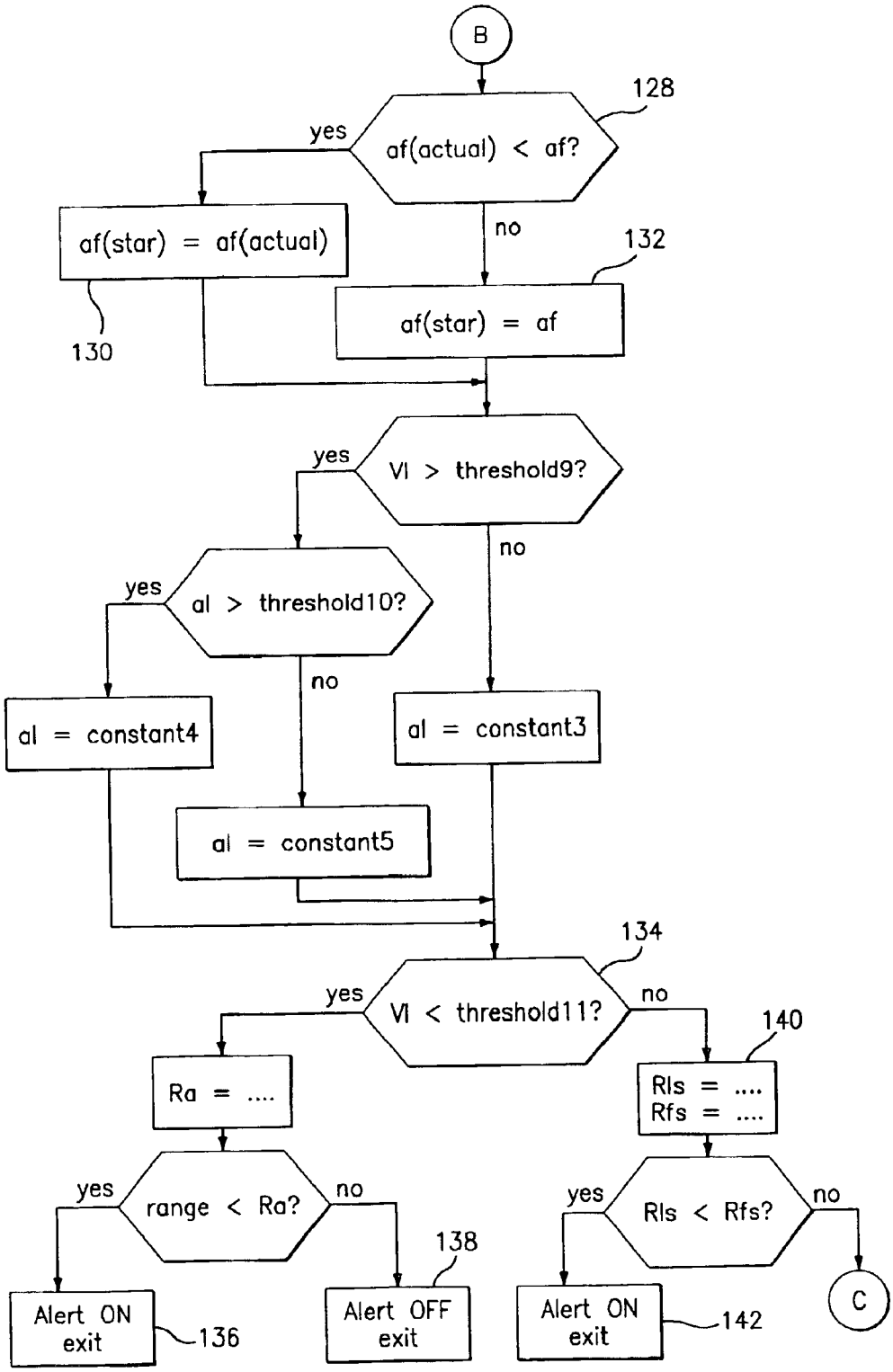
Figure 4D:
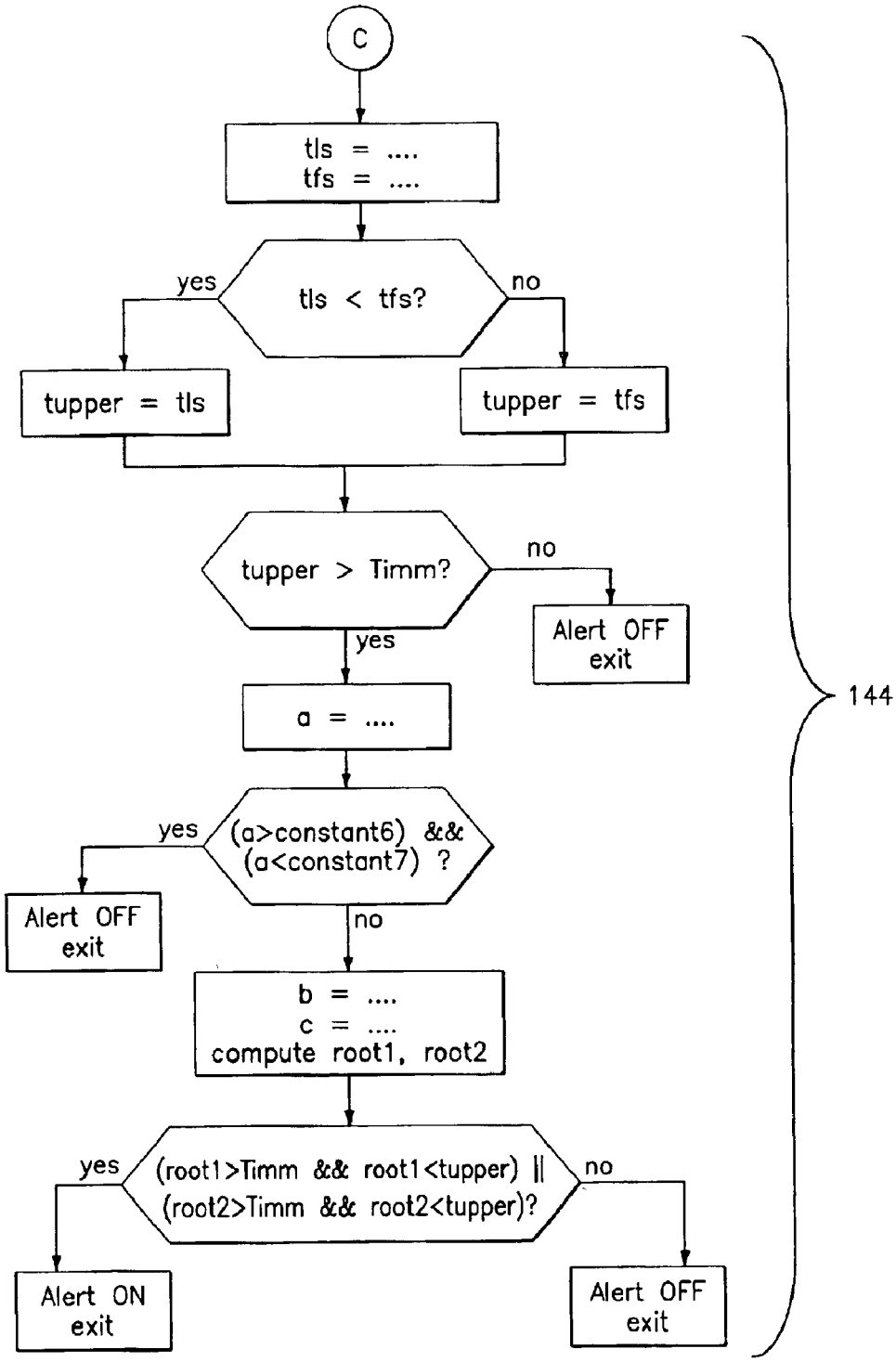

FIG. 3 is a schematic diagram of a lead vehicle 22 and a follow (host) vehicle 24, particularly illustrating some of the measured/calculated parameters used by the threat assessment algorithm 12. As is shown, the range between the vehicles is the distance between the front of the follow vehicle and the rear of the lead vehicle. The measured/calculated parameters such as velocity, acceleration, range rate and relative acceleration are positive in the longitudinal direction of travel of the vehicles, and negative in the opposite direction. A frontal sensor in the host vehicle is preferably used to sense a number of detectable objects in the frontal area of the host vehicle; however, only a single object is selected as the closest in path object used by the threat assessment algorithm operates on. The particular mode of selecting the closest in path object may be chosen from any available methods known to those skilled in the art, and is not discussed in further detail hereinafter.

Referring generally now to FIGS. 4(*a*) through 4(*d*), there is shown a flow diagram 100 of an exemplary, detailed embodiment of the operation of the threat assessment algorithm 12. In the description of the particular algorithm embodiment that follows, the flow diagram 100 illustrates in the nomenclature, constants, etc., of the threat assessment algorithm 12 in pseudo-code. However, it should be understood that any constants presented therein are exemplary in nature, and thus should not be used to interpret the algorithm in any limiting sense. Rather, the constants are primarily used to tune the algorithm for a specific vehicle and general customer profile and, as such, may vary from application to application.

As will be later understood from the flow diagram 100, several parameters are used in the implementation of the threat assessment algorithm 12, and are first outlined herein in greater detail. Generally speaking, there are three unknown parameters used to calculate and estimate the kinematics of vehicles. These parameters include the host vehicle's total response time to a warning, the acceleration/deceleration of the lead vehicle, and the acceleration/deceleration of the following vehicle.

The host vehicle's total response time in turn has three basic components. These components include the driver response time, the system response time and the brake response time. The system response time is characterized by the delay in detecting and verifying the presence of an object in the frontal area of the vehicle, then determining if the object is in the path of the vehicle. Then, the threat assessment situation is determined and, finally, a warning is issued if needed. The brake response time is the delay in the brake system to build up the pressure in the hydraulics to apply the brakes. Stated differently, the brake response time is the time delay from the instant the driver presses the brake pedal to the instant that affects the brakes. Thirdly, the driver response time is the time delay from the moment a warning is issued by the FCW system (assuming the warning is recognized by the driver) to the instant the driver executes an evasive action, such as braking and/or steering.

While both the system response time and brake response time are deterministic in nature, the driver response time is not. Depending upon the physiological and/or psychological state of the driver, the driver response time may vary, sometimes significantly, from one driver to another. For example, it has been established that there are variations in response time among age and gender groups. Accordingly, the system 10 provides a means for selecting a system sensitivity level that reflects the personal driving preference of the host vehicle driver, from aggressive to conservative in multiple gradings. The particular sensitivity setting chosen by the driver is used to determine an estimate for the driver response time.

Lead vehicle acceleration is another parameter that is estimated. First, the instantaneous lead vehicle acceleration/deceleration may be determined by directly measuring or computing the host vehicle (or following vehicle) acceleration, and then measuring or computing the relative acceleration between the host and lead vehicles. In either case, the instantaneous acceleration of the host vehicle is determined, such as through the use of a longitudinal accelerometer. This approach provides superior accuracy, but is relatively expensive due to the added cost of the accelerometer.

Alternatively, a second technique of computing of the host vehicle acceleration is based on successive speed measurements taken at known intervals. However, this approach is susceptible to noisy results that may be unacceptable in certain situations. While suitable filtering could minimize the noise in the computation, a downside associated therewith is the time delay. Similarly, the relative acceleration between the host and the lead vehicles can either be measured or computed. Measuring this parameter using radar is a relatively expensive approach. However, a more practical approach is to compute the relative acceleration from relative velocity (one of the parameters already measured by the forward looking sensor/radar), as well as the rate of these measurements, thus yielding the current acceleration/deceleration of the lead vehicle.

By the time the instantaneous acceleration is determined, it is possible that the driver of the lead vehicle could already be executing a braking maneuver that might render the threat assessment algorithm ineffective. As such, the algorithm will further take into consideration a prediction of how the lead vehicle driver will behave in the future with respect to braking. In this respect, statistical studies have established that 98 percent of vehicles brake at a rate of 0.2 g or less when the driver brakes. Thus, at any given time, it is assumed that the lead vehicle is about to brake at this default rate, representing a worst-case condition. During most sample times and braking activity of the lead vehicle will brake around the 0.2 g value. For the statistically few times the lead vehicle brakes at a higher value. Once a given threshold is exceeded, the measured/computed value will be used in the threat assessment algorithm 12. It will be appreciated, however, that a different default value for the braking of the lead vehicle may be used, depending upon the particular vehicle application.

Finally, the threat assessment algorithm 12 uses host vehicle acceleration estimation. While instantaneous vehicle acceleration is the easiest of the parameters to measure, predicting how the driver will respond once an alert is generated is a more complicated matter. For example, the host vehicle could be cruising at a constant speed (i.e., at zero acceleration) when, due to slower or stationary vehicles/objects in the predicted path of the host vehicle, an alert could be generated. As a result of the alert, the driver will likely apply the brakes, but the level of braking applied in general is not likely to be consistent with other braking situations. Experiments conducted with a number of drivers have shown that the driver's braking behavior depends on how fast the host vehicle is traveling as well as the closing speed between the host vehicle and lead vehicle.

Thus, in the present algorithm embodiments, a driver's braking behavior is classified into a finite number of cases for practical purposes. For example, when the lead vehicle is stationary and the host vehicle is closing in on the lead vehicle, an alert is produced at a certain some range and the driver thereby responds with a certain brake force. If the lead vehicle is moving and the host vehicle is closing in on the lead vehicle at very low range rate, an alert is still produced at a certain range. In this case however, the driver's brake force is like quite different than in the former case. As such, a number of cases have been identified wherein the driver's behavior exhibits a different braking level, depending on the host vehicle speed and closing speed.

Returning now to FIGS. 4(*a*) through 4(*d*), the threat assessment algorithm 12 as embodied in the flow diagram begins upon entry at start block 102, where the process is entered if the velocity of the host vehicle is greater than a preset constant. Then, above discussed data parameters are received for the present sample time at block 104. As indicated generally at 106, the algorithm initially runs through a series of exit criteria wherein, if any of the inquiries are answered in the affirmative, then the routine exits until the next sample time. Such inquiries include (but are not necessarily limited to) whether the driver of the host vehicle is already braking above a certain threshold value (block 108), whether the lead vehicle is actually an oncoming vehicle (block 110), whether the lead vehicle is "opening" or pulling away from the host vehicle (block 112), whether the lead vehicle is stationary while the host vehicle is beyond a certain range (block 114—in the event that the sensing device may not be able to distinguish the closest in path vehicle as on or above the same surface/level such as due to overpasses, bridges, signs, etc.), and whether the host vehicle is accelerating greater than a certain threshold, indicating the host vehicle driver's intent to overtake the lead vehicle (block 116).

Assuming that none of the exit criteria are met, the algorithm proceeds to FIG. 4(*b*) where, as indicated generally at 118, an operating region for the host and lead vehicle is established, using the velocity and acceleration of the host and lead vehicle. When the operating region is established, a series of constants are assigned (under one of blocks 120*a*, 120*b*, 120*c*, 120*d*) for use in calculating the estimated braking ($a_f$) of the host vehicle, shown in block 122. Then, if $a_f$ is found to be outside an established range, than either a lower limit or an upper limit is set for $a_f$, as shown in blocks 124 and 126, respectively. It should be noted that the depicted illustration of the operating region is exemplary in nature, and may be further refined such as by implementing a continuous function for determining $a_f$ in block 122.

In FIG. 4(*c*), the computed estimated value of $a_f$ is compared with the actual vehicle acceleration/deceleration value $a_f$ (actual), as shown at block 128. If $a_f$ (actual) is less than the estimated $a_f$, then the host vehicle acceleration used in subsequent computations $a_f$ (star) is set to $a_f$ (actual) at block 130. Otherwise $a_f$ (star) is set to the estimated value $a_f$ at block 132. Continuing to block 132, it is determined if the lead vehicle is stationary by comparing its velocity, $V_1$, to a threshold value. If the lead vehicle is moving, then either the actual deceleration value is used or the assumed deceleration (−0.2 g) is used, as discussed earlier.

The remaining portions of the threat assessment algorithm 12 are directed toward the projected paths of the lead and host vehicles, using the values calculated and assigned above. Specifically, the deterministic and the estimated data are used to compute a range profile of the host and the lead vehicles over time is computed. Each of the range profiles is a monotonically increasing function, which will asymptotically reach a constant value. The asymptotic values represent the range at which both vehicles come to a full stop, assuming behavior in accordance with their predicted decelerations as well as the vehicle dynamics data.

If the data indicates that the lead vehicle will come to a stop at a further range than the host vehicle, then this is suggestive that there will not be an impact between the two, although this is not necessarily the case. On the other hand, if the range profiles determine that the lead vehicle will come to a stop at a closer range than the following vehicle, then an impact is likely at or before the final stopping point, and an alarm indication is given. In this regard, the algorithm first determines whether the lead vehicle is moving or is stationary, as shown at block 134. If the lead vehicle is stationary, its final stopping position is the current position, and the decision on issuing a warning simply comes down to whether the host vehicle will come to a stop at a point before the location of the stationary lead vehicle. If not, the alert warning is "ON" at block 136, and the algorithm exits. If the host vehicle is projected to come to a stop before the lead vehicle, the alert warning is "OFF" at block 138, and the algorithm exits.

On the other hand, if the lead vehicle is also moving, then a projected stopping range for both vehicles is computed, shown at block 140. If the projected stopping point of the lead vehicle is less than the projected stopping point of the host vehicle, then the alert warning is "ON" at block 142, and the algorithm exits.

However, even if the final projected stopping point of the lead vehicle is not less than the projected stopping point of the host vehicle, the entire trajectory for each vehicle is analyzed, as there is still the possibility of an impact at some intermediate point prior to the final projected stopping points. In this event, the algorithm then proceeds to FIG. 4(*d*) where, as generally indicated at 144, it is determined whether the trajectories of the two vehicles intersect at any given point in time before the stopping points are reached. If the trajectories are projected to intersect, then the alert is "ON"; if not, then the alert is "OFF" and the algorithm finally exits.

Figure 5:
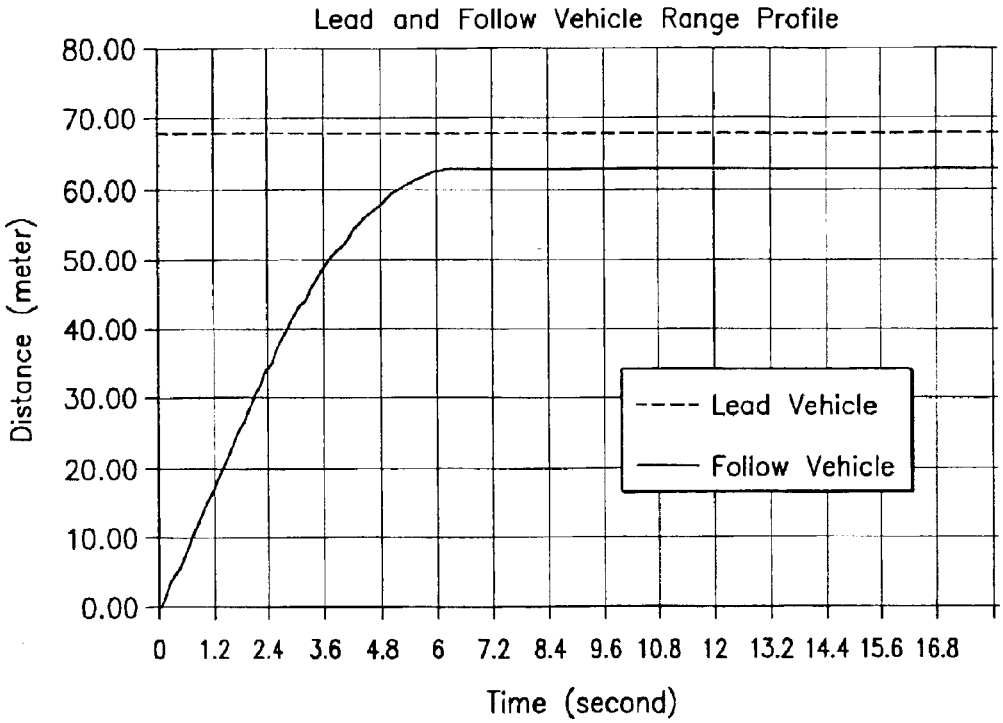
FIGS. 5 through 9 are range curves for both a lead and a following vehicle, illustrating various scenarios identifiable by the threat assessment algorithm.

The intersection of trajectories and the computation of vehicle ranges to a stopping point, as performed by the threat assessment algorithm is perhaps best illustrated in a graphical manner as shown in FIGS. 5–9. In FIG. 5, the graph shown therein an example wherein the host vehicle approaches a stationary lead vehicle. The horizontal axis of the graph is the time, while the vertical axis is the distance. The curves for both the lead and follow vehicles are computed and evaluated at each sampling instant of the forward-looking sensor. In the example of FIG. 5, the lead vehicle is stationary at 68 meters, and is determined to be in the predicted path of the following vehicle. At time t=0 seconds, the follow vehicle is traveling at a speed of 40 mph towards the lead vehicle, and it is assumed at that point (for purposes of the simulation) the driver of the follow vehicle is alerted by the FCW system to apply the brakes.

It will be noted that the curve for the lead vehicle is a constant horizontal line, since it is stationary. If the driver of the follow vehicle applies the brakes in the predicted manner, the follow vehicle will decelerate as reflected by the follow vehicle curve until it comes to a full stop at around the 5 second mark. As can be seen, the follow vehicle comes to a stop at a range less than the stationary position of the lead vehicle and, as such, no warning is issued during this sample time. Again, in the calculation of the follow vehicle curve, the driver's braking behavior is estimated, based upon the selected sensitivity level. For purposes of illustration, a driver delay of 1.6 seconds is chosen, which is roughly a mid-level sensitivity setting. It will be noted that, prior to the driver's braking input at about 1.6 seconds, the follow vehicle range curve is linear, indicating a constant velocity with no deceleration. Once the brakes are applied, the eventually come to a full stop in a non-linear manner in about 5 seconds. Again, since the two curves do not intersect, there is no likelihood of an impact with the lead vehicle, and thus no warning will be given.

Figure 6:
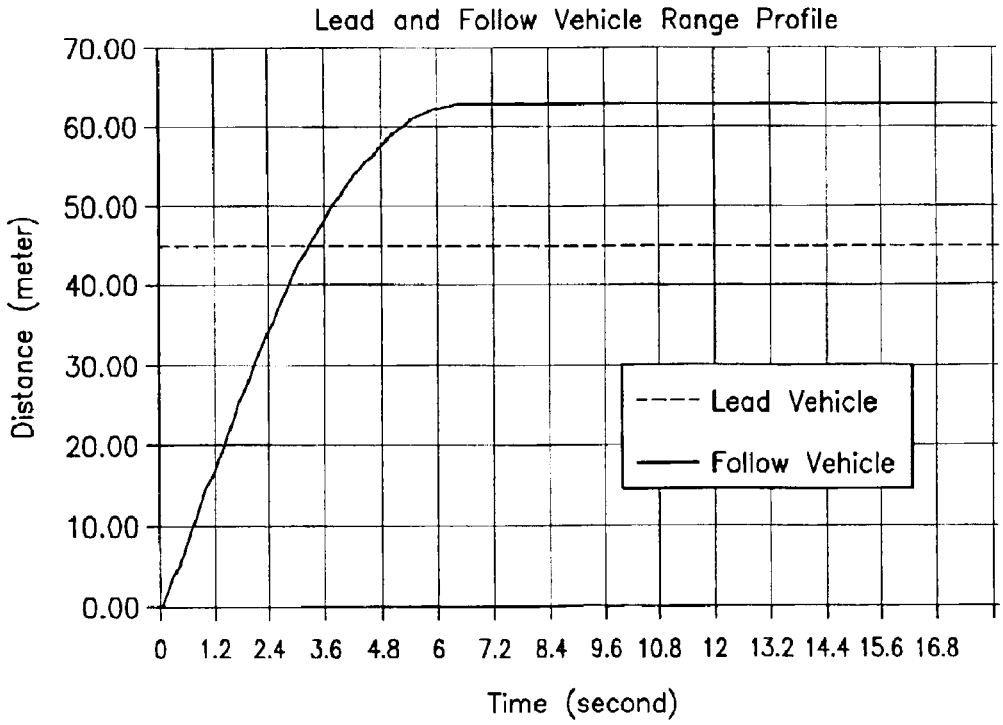

FIG. 6 illustrates another example wherein the driver of the follow vehicle is warned at t=0 seconds and when the lead vehicle is stationary at a range of 45 meters. Although the stopping curve for the follow vehicle is the same as in FIG. 5, the initial range to the lead vehicle is shorter. Thus, in this case, there is a projected impact at around the 2.8 second mark. Were an actual stationary object to appear in front of the host vehicle at that range, the system would issue an immediate warning. Although there would most likely be an impact nonetheless, a warning could assist the driver in reducing the energy of an impact.

Figure 7:
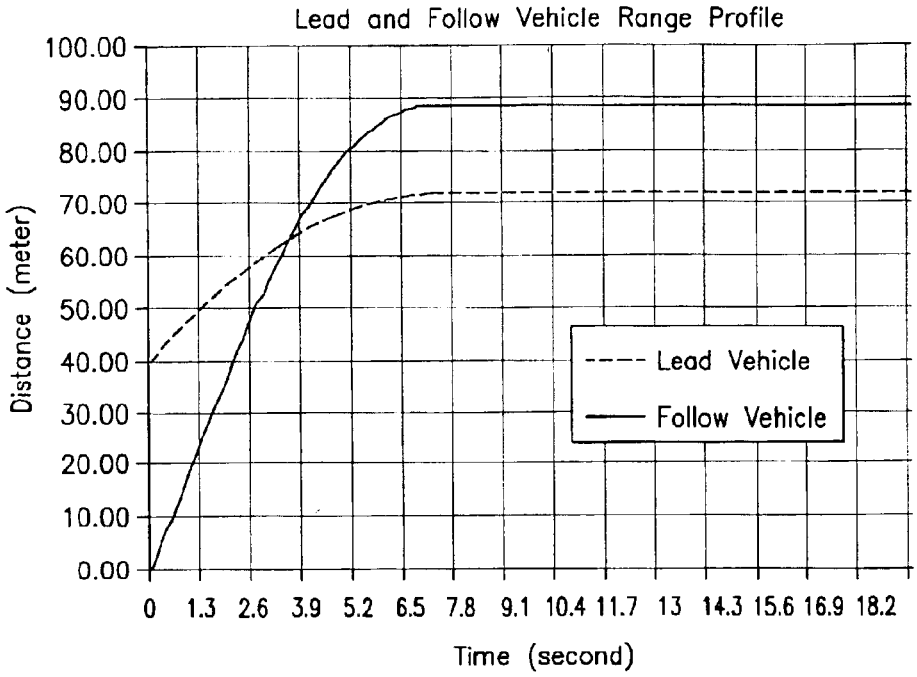

FIG. 7 illustrates still another example, wherein the driver of the following vehicle is initially traveling at a speed of 55 mph when the lead vehicle cuts in at a range of 40 meters and a speed of 25 mph. At that point, the lead vehicle could be accelerating, coasting at constant velocity, or decelerating. For accelerating and coasting conditions, it is generally assumed that the lead vehicle is decelerating at a constant rate of −0.2 g. If it is determined that the lead vehicle is decelerating at a rate less than −0.2 g, then the actual deceleration is used. The predicted reaction time is based on the driver selection and the following vehicle deceleration rate is based on the kinematics conditions. In this case an impact is predicted to be around the 2.8 second mark and, accordingly, and alarm is triggered.

Figure 8:
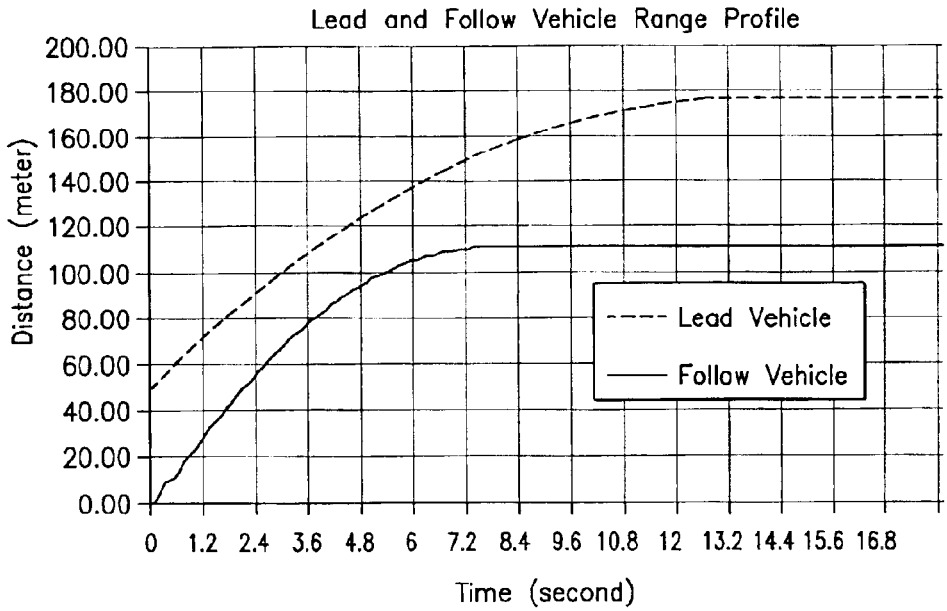

In FIG. 8, there is shown another example in which the following vehicle is moving at a speed of 65 mph while the lead vehicle appears at a range of 60 meters and moving at a speed of 50 mph. Again, the lead vehicle could be accelerating, coasting, or decelerating, and the values used for deceleration are determined in the same manner as stated previously. This time, as reflected by the calculated range curves, there is no projected impact and therefore no warning is issued. In case both vehicles continue at these speeds, there is a potential for conflict, as indicated in the next case.

Figure 9:
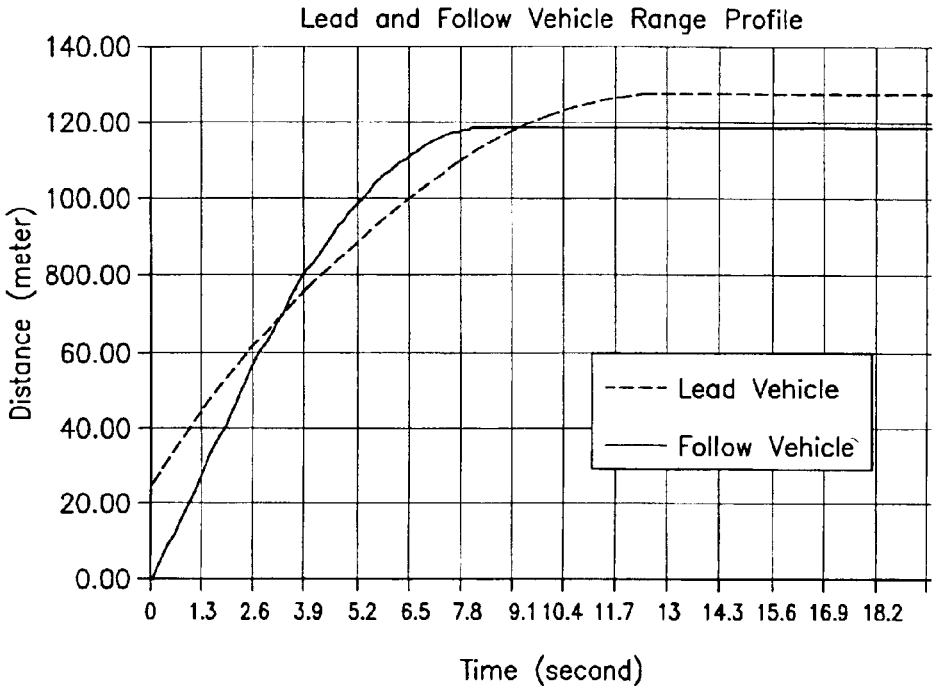

Finally, FIG. 9 illustrates an example of why (although the projected stopping point of the lead vehicle is further than the projected stopping point of the following vehicle) the algorithm still runs a trajectory analysis to look for intersections of the curve at one or more intermediate points. Initially, the following vehicle is moving at a speed of 65 mph while the lead vehicle is at 25-meter range while moving at a speed of 45 mph. As can be seen, the final stopping range of lead vehicle is greater than the final stopping range of the following vehicle. This information, by itself, indicates that there would be no impact. However, a further analysis of the graph reveals that there is an intersection of the trajectories and thus a predicted impact in an intermediate position. As such, an alarm would be generated during this sample period.

It will thus be appreciated that the above described threat assessment algorithm (configured so as to take into account predicted host vehicle driver's behavior) contributes to a robust FCW system that results in reduced incidents of false alarms, as well as missed detections, which in turn increase the overall effectiveness of the system. Specifically, this algorithm uses the estimated driver braking behavior to establish certain parameters used in computation of the vehicle kinematics to determine if a warning signal is issued to the driver.

As will also be appreciated, the disclosed invention can be embodied in the form of computer or controller implemented processes and apparatuses for practicing those processes. The present invention can also be embodied in the form of computer program code containing instructions embodied in tangible media, such as floppy diskettes, CD-ROMs, hard drives, or any other computer-readable storage medium, wherein, when the computer program code is loaded into and executed by a computer or controller, the computer becomes an apparatus for practicing the invention. The present invention may also be embodied in the form of computer program code or signal, for example, whether stored in a storage medium, loaded into and/or executed by a computer or controller, or transmitted over some transmission medium, such as over electrical wiring or cabling, through fiber optics, or via electromagnetic radiation, wherein, when the computer program code is loaded into and executed by a computer, the computer becomes an apparatus for practicing the invention. When implemented on a general-purpose microprocessor, the computer program code segments configure the microprocessor to create specific logic circuits.

While the invention has been described with reference to a preferred embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A method for predicting an impact condition between a host vehicle and an object detected in a path of travel of the host vehicle, the method comprising:

receiving measured parameters from the host vehicle and the object;

receiving a system sensitivity input from a driver of the host vehicle, the system sensitivity input being chosen by the host vehicle driver and reflecting the personal driving preference of the host vehicle driver;

estimating a braking response of the driver of the host vehicle, said estimated braking response based on said received system sensitivity input; and determining a projected travel range profile for both the host vehicle and the object, based upon said measured parameters and said estimated braking response;

wherein, the impact condition is established whenever a comparison of said projected travel range profile for the host vehicle and for the object establishes an intersection therebetween.

2. A method for predicting an impact condition between a host vehicle and an object detected in a path of travel of the host vehicle, the method comprising:

receiving measured parameters from the host vehicle and the object;

receiving a system sensitivity input from a driver of the host vehicle;

estimating a braking response of the driver of the host vehicle, said estimated braking response based on said received system sensitivity input; and determining a projected travel range profiled for both the host vehicle and the object, based upon said measured parameters and said estimated braking response;

wherein, the impact condition is established whenever a comparison of said projected travel range profile for the host vehicle and for the object establishes an intersection therebetween; and wherein said projected travel range profile for the host vehicle is determined by calculating a deceleration value for the host vehicle, said calculated deceleration value being a function of said estimated braking response, and wherein said estimated braking response of the driver of the host vehicle is further based upon the host vehicle velocity and a closing speed of the object.

3. The method of claim 2, wherein said projected travel range profile for the object is determined by assigning a deceleration value for the object, said assigned deceleration value being based upon a velocity and an acceleration of the object.

4. The method of claim 3, wherein said assigned deceleration value for the object is set to a default value whenever the magnitude of the actual deceleration of the object is at or below said default value, and said assigned deceleration value for the object is set to the actual deceleration of the object whenever the magnitude of the actual deceleration of the object exceeds said default value.

5. The method of claim 4, wherein said default value is about −0.2 g.

6. The method of claim 2, wherein if the object is determined to be stationary, and said projected travel range of the host vehicle yields a stopping distance less than the position of the object, then the impact condition is not established.

7. The method of claim 2, wherein if the object is determined to be stationary, and said projected travel range of the host vehicle yields a stopping distance equal to or greater than the position of the object, then the impact condition is established.

8. A method for generating a frontal impact warning for a driver of a host vehicle, the method comprising:

determining, during a given sample time period, actual velocity and acceleration data for both the host vehicle and for a lead vehicle detected in the path of travel of the host vehicle;

estimating a braking response of the driver of the host vehicle;

assigning a deceleration value for the lead vehicle;

generating a projected travel range for the host vehicle, based upon said actual velocity data for the host vehicle and the lead vehicle, and further based upon said estimated braking response of the driver of the host vehicle;

generating a projected travel range for the lead vehicle, based upon said actual velocity data for the lead vehicle and upon said assigned deceleration value for the lead vehicle; and comparing said projected travel range for the host vehicle with said projected travel range for the lead vehicle and generating an alert signal to the host vehicle driver whenever an intersection of travel ranges therebetween is calculated.

9. The method of claim 8, wherein said estimated braking response of the driver of the host vehicle is based upon a system sensitivity input from the driver of the host vehicle, upon the velocity of the host vehicle, and a closing speed of the lead vehicle.

10. The method of claim 9, wherein said system sensitivity input is selected from a plurality of discrete settings corresponding to the reaction time of the host driver in performing a braking operation.

11. The method of claim 8, wherein said assigned deceleration value for the lead vehicle is set to a default value whenever the magnitude of the actual deceleration of the lead vehicle is at or below said default value, and said assigned deceleration value for the lead vehicle is set to the actual deceleration of the lead vehicle whenever the magnitude of the actual deceleration of the lead vehicle exceeds said default value.

12. The method of claim 11, wherein said default value is about −0.2 g.

13. The method of claim 8, wherein if the lead vehicle is determined to be stationary, and said projected travel range of the host vehicle yields a stopping distance less than the position of the lead vehicle, then the alert signal is not generated.

14. The method of claim 8, wherein if the object is determined to be stationary, and said projected travel range of the host vehicle yields a stopping distance equal to or greater than the position of the object, then the impact condition is established.

15. The method of claim 8, further comprising:

determining, upon receiving said actual velocity and acceleration data for both the host and lead vehicles, whether any of a plurality of exit criteria are present during said current sample time period and, if so, then said projected travel ranges for the host and lead vehicles are not generated during said current sample time period.

16. The method of claim 15, wherein said exit criteria include at least one of:

a determination that the driver of the host vehicle is in the process of braking;

a determination that the lead vehicle is an oncoming vehicle;

a determination that the lead vehicle is opening or accelerating at a rate so as to increase its range from the host vehicle; and a determination that the driver of the host vehicle is accelerating the host vehicle so as to overtake the lead vehicle.

17. A forward impact warning system, comprising:

an algorithm for assessing the likelihood of a frontal collision between a host vehicle and a lead vehicle detected in the path of travel of the host vehicle, said algorithm having actual velocity and acceleration data for the host vehicle and the lead vehicle as inputs thereto;

said algorithm further estimating a braking response of the driver of the host vehicle, and generating a projected travel range for the host vehicle, based upon said actual velocity data for the host vehicle and the lead vehicle, and further based upon said estimated braking response of the driver of the host vehicle;

said algorithm further assigning a deceleration value for the lead vehicle, and generating a projected travel range for the lead vehicle, based upon said actual velocity data for the lead vehicle and upon said assigned deceleration value for the lead vehicle; and a warning alert mechanism, in communication with said algorithm, said warning alert mechanism generating an alert signal to the driver of the host vehicle whenever said algorithm identifies an intersection between said projected travel range for the host vehicle and said projected travel range for the lead vehicle.

18. The system of claim 17, wherein said algorithm further includes a system sensitivity input thereto, said system sensitivity input being selected from a plurality of discrete settings corresponding to the reaction time of the host driver in performing a braking operation.

19. The system of claim 18, wherein said estimated braking response of the driver of the host vehicle is based upon said system sensitivity input, and upon the velocity of the host vehicle and a closing speed of the lead vehicle.

20. The system of claim 17, wherein said assigned deceleration value for the lead vehicle is set to a default value whenever the magnitude of the actual deceleration of the lead vehicle is at or below said default value, and said assigned deceleration value for the lead vehicle is set to the actual deceleration of the lead vehicle whenever the magnitude of the actual deceleration of the lead vehicle exceeds said default value.

21. The system of claim 20, wherein said default value is about −0.2 g.

22. A storage medium, comprising:

a machine readable computer code for predicting an impact condition between a host vehicle and an object detected in a path of travel of the host vehicle; and instructions for causing a computer to implement a method, the method further comprising:

receiving measured parameters from the host vehicle and the object;

receiving a system sensitivity input from a driver of the host vehicle, the system sensitivity input being chosen by the host vehicle driver and reflecting the personal driving preference of the host vehicle driver;

estimating a braking response of the driver of the host vehicle, said estimated braking response based on said received system sensitivity input; and determining a projected travel range profile for both the host vehicle and the object, based upon said measured parameters and said estimated braking response;

wherein, the impact condition is established whenever a comparison of said projected travel range profile for the host vehicle and for the object establishes an intersection therebetween.

* * * * *